US005511469A

United States Patent [19]

Satake et al.

[11] Patent Number: 5,511,469

[45] Date of Patent: Apr. 30, 1996

[54] ABRASIVE TYPE VERTICAL GRAIN MILLING MACHINE

[75] Inventors: Satoru Satake, Tokyo; Shigeharu Kanamoto, Mihara; Yutaka Okada, Higashihiroshima; Nobuhiro Matsumoto, Kure, all of Japan

[73] Assignee: Satake Corporation, Tokyo, Japan

[21] Appl. No.: 382,920

[22] Filed: Feb. 3, 1995

[30] Foreign Application Priority Data

Feb. 17, 1994 [JP] Japan ..... 6-044916

[51] Int. Cl.[6] ..... B02B 3/00; B02B 3/04; B02B 3/06; B02B 7/02

[52] U.S. Cl. ..... 99/519; 99/523; 99/524; 99/528; 99/606; 99/607; 99/609; 99/617

[58] Field of Search ..... 99/518–525, 528, 99/600–602, 605–608, 609, 612–615, 617, 620, 622; 426/481–483; 51/4, 22, 72 R, 307–309; 241/57, 58, 74, 49, 260.1, 257.1

[56] References Cited

U.S. PATENT DOCUMENTS 3,885,464 5/1975 Ceballos-Aguilera .
5,390,589 2/1995 Satake et al. ..... 99/519
5,394,792 3/1995 Satak et al. ..... 99/519

FOREIGN PATENT DOCUMENTS

0427504A3 5/1991 European Pat. Off. .
0427504A2 5/1991 European Pat. Off. .
229597 11/1943 Switzerland .
446426 4/1936 United Kingdom .
1170453 11/1969 United Kingdom .
1577979 10/1980 United Kingdom .

*Primary Examiner*—Timothy F. Simone
*Attorney, Agent, or Firm*—Darby & Darby

[57] ABSTRACT

There is disclosed an abrasive type vertical grain milling machine in which a space formed between any two adjacent ones of abrasive rolls serves as a jet air groove. The space serving as the jet air groove is of such an axial size that grain to be milled can come into and out of the space. Preferably, an axial thickness of the abrasive roll is 1.5~4 times larger than an axial magnitude of the space.

7 Claims, 4 Drawing Sheets

ABRASIVE TYPE VERTICAL GRAIN MILLING MACHINE

BACKGROUND OF THE INVENTION

1. Field of the Invention

This invention relates to an abrasive type vertical grain milling machine for cereal grains such as rice grains and wheat grains.

2. Description of the Related Art

One known milling machine of the type described is disclosed in British Patent Specification No. 1,577,979. This conventional grain milling machine will now be described with reference to FIG. 5. A spiral or helical feed roll 52 and a plurality of abrasive milling rolls 53 are mounted on a main shaft 51 rotatably mounted in an upstanding bran-removing cylinder 50 of the abrasive type vertical grain milling machine 49, and a space or gap 54, formed between any two adjacent abrasive rolls 53, serves as a jet air groove. An upper end of a grain milling chamber 55 whose main portion is defined by the bran-removing cylinder 50 and the abrasive rolls 53, communicates with a grain supply portion 56 while a lower end thereof communicates with a grain discharge portion 57.

In this conventional abrasive type vertical grain milling machine 49, grain supplied to the grain supply portion 56, is fed to the grain milling chamber 55 by the spiral roll 52, and is milled or whitened in this chamber 55 by a grain milling or whitening operation effected by the rotation of the abrasive rolls 53. The grains thus milled are discharged from the grain discharge portion 57, and powder-like matters, such as bran, produced by the grain milling operation, are discharged to the exterior of the milling machine 49 through holes or perforations 50*a* in the bran-removing cylinder 50 by jets of air emitted from the jet air grooves 54.

In the above-mentioned conventional abrasive type vertical grain milling machine 49, however, the grains, flowing downward in the grain milling chamber 55, is milled only by an outer peripheral or side surface 53*a* of each abrasive roll 53 of a hollow cylindrical or annular shape. The reason for this is that the space or gap 54 serving as the jet air groove is designed small so that the grains can not intrude into the space 54, and so that any grain milling operation can not be effected by upper and lower surfaces (i.e., end faces) 53*b* and 53*c* of the abrasive rolls 53. Therefore, in order to enhance the grain milling effect, it is necessary to increase the number of times the grains are passed through the grain milling chamber 55, and this has resulted in a drawback that the grain milling efficiency is not high.

U.S. Ser. No. 08/202,788 now U.S. Pat. No. 5,395,059 commonly assigned teaches "Spacer for abrasive roll of abrasive type grain milling machine". U.S. Ser. No. 08/274,981 now U.S. Pat. No. 5,394,792 commonly assigned teaches "Bran-removing perforated cylindrical body of abrasive type grain milling machine". U.S. Ser. No. 08/259,171 (allowed on Dec. 5, 1994) commonly assigned teaches "Resistance member adjusting mechanism of abrasive type grain milling machine". These three U.S. Patent are incorporated herein by reference thereto.

SUMMARY OF THE INVENTION

With the above drawbacks in view, it is an object of this invention is to provide an abrasive type vertical grain milling machine in which an effective grain milling area is increased, thereby significantly enhancing a grain milling efficiency.

According to the present invention, there is provided an abrasive type vertical grain milling machine comprising:

an upstanding bran-removing cylinder;

a main shaft rotatably mounted within the bran-removing cylinder, the main shaft extending substantially vertically;

a spiral roll mounted on the main shaft for feeding grains to be milled; and a plurality of abrasive rolls mounted on the main shaft for milling the grains, the plurality of abrasive rolls being spaced from one another along the main shaft to define a space or gap between any two adjacent ones of the abrasive rolls serving as a jet air groove;

the bran-removing cylinder and the plurality of abrasive rolls cooperating with each other to form or define a main portion of a grain milling chamber there-between, an upper end of the grain milling chamber being connected to a grain supply portion while a lower end of the grain milling chamber is connected to a grain discharge portion;

wherein the space or gap serving as the jet air groove is of such an axial size that the grain can come into and out of the space or gap.

In the abrasive type vertical grain milling machine of the present invention, grains supplied to the grain supply portion are fed by the spiral roll to the grain milling chamber where the grains are milled by a milling or whitening operation effected by the rotation of the abrasive rolls. At this time, the grains not only are brought into contact with the outer peripheral or side surface of each abrasive roll but also come into and out of the space or gap serving as the jet air groove to be milled also by the upper and lower axial end faces of the opposed abrasive rolls. As a result, the effective milling area is significantly increased, and the milling efficiency is significantly enhanced.

Therefore, if the same milling ability is to be obtained, the height of the machine can be significantly reduced as compared with the conventional abrasive type vertical grain milling machine.

The milled grains are discharged from the grain discharge portion, and powder-like matters, such as bran, produced as a result of the grain milling operation are discharged to the exterior of the machine through perforations in the bran-removing cylinder by jets of air emitted from the jet air grooves.

Preferably, a thickness of the abrasive roll is 1.5~4 times larger than an axial thickness of the space, i.e. a magnitude of the gap, serving as the jet air groove. In this case, a most preferred grain milling operation is carried out.

In one preferred form of the invention, at least one of the abrasive rolls comprises a support portion fitted on the main shaft at a boss portion thereof, and an annular abrasive portion fixedly secured to an outer periphery of the support portion, and an axial thickness of the boss portion of the support portion is greater than an axial thickness of the abrasive portion.

Preferably, the support portion comprises the boss portion, a plurality of arm portions extending radially outwardly from the boss portion, and a ring portion integrally connected to outer ends of the arm portions, and the abrasive portion is fixedly secured to an outer periphery of the ring portion. In this case, the boss portion of the support portion may be projected, beyond the abrasive portion in the axial direction, at one of or both of its axial end faces.

A spacer may be provided between at least two adjacent ones of the abrasive rolls.

The foregoing and other objects, features and advantages of the invention will be made clearer from description hereafter of preferred embodiments with reference to attached drawings.

DESCRIPTION OF THE PREFERRED EMBODIMENTS

A preferred embodiment of an abrasive type vertical grain milling machine of the present invention designed, for example, for whitening rice (grain) will now be described with reference to FIGS. 1 to 3 and 4A.

Figure 1:
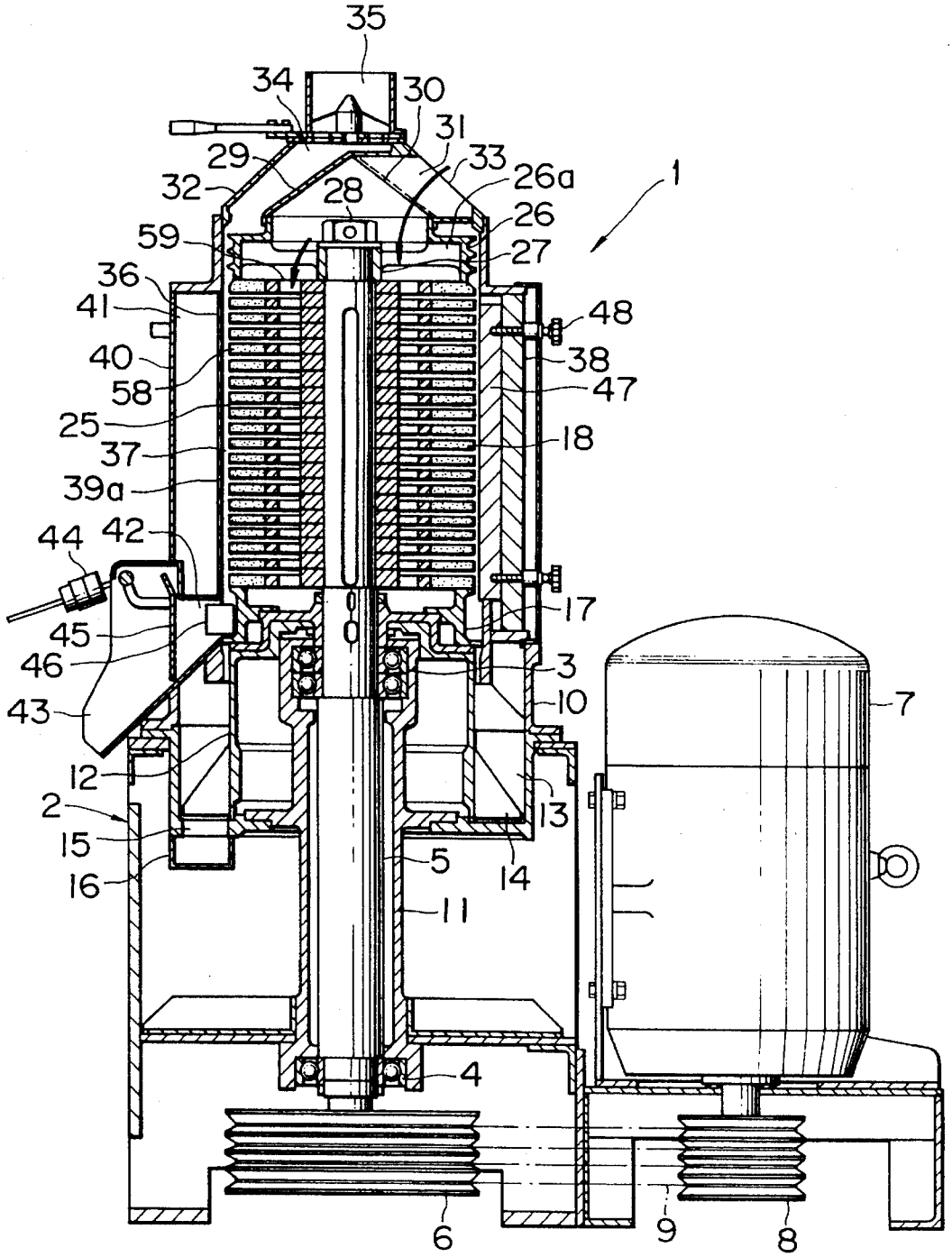
FIG. 1 is a vertical sectional view of one preferred embodiment of an abrasive type vertical grain milling machine of the present invention taken along a line I—I of FIG. 3.
Figure 2:
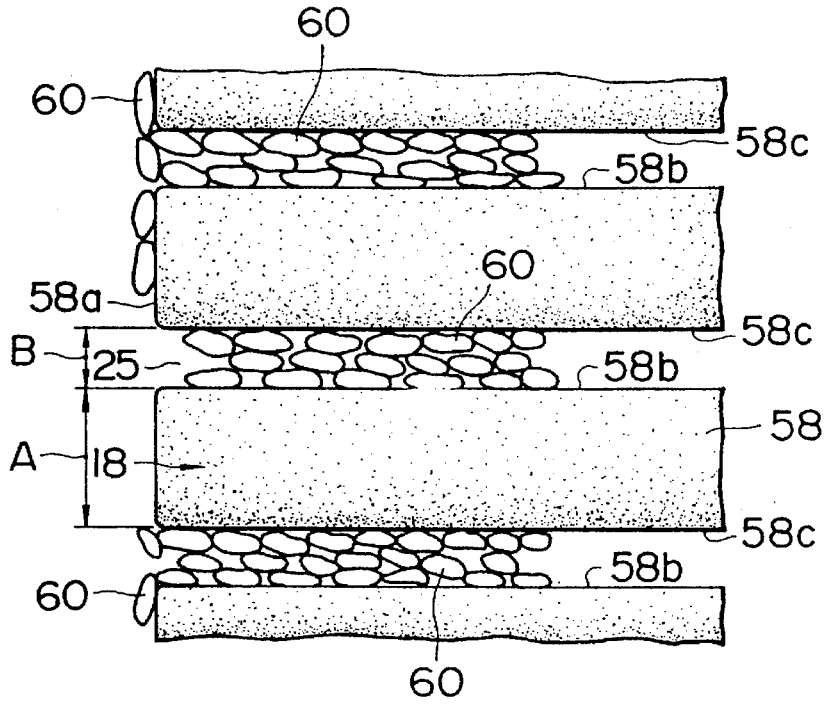
FIG. 2 is a fragmentary, enlarged view of abrasive rolls.
Figure 3:
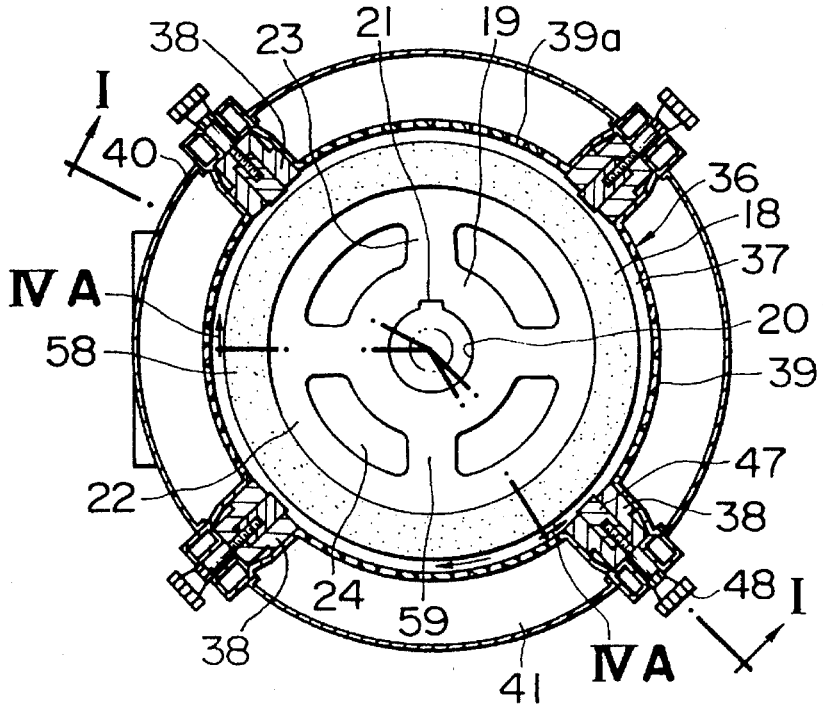
FIG. 3 is a horizontal cross-sectional view of the abrasive type vertical grain milling machine.

In FIG. 1 which is a general vertical sectional view of the abrasive type vertical grain milling machine 1, a main shaft 5 is vertically disposed in a base 2 at a central portion thereof, and is rotatably supported by upper and lower bearings 3 and 4. A pulley 6 is mounted on a lower end of the main shaft 5, and is connected to a pulley 8 of a motor 7 by a V-belt 9, so that the main shaft 5 can be rotated at a suitable rotational speed. The main shaft 5 is of a hollow construction to achieve a lightweight design, and a generally upper half of the main shaft 5 is projected upwardly beyond the base 2.

A bran-collecting hollow cylinder 10 with an open top is supported on and fixedly secured to an upper edge portion of the base 2 and a bearing cylinder 11 in surrounding relation to the upper bearings 3. A rotary hollow cylinder 12 with an open bottom is disposed within the bran-collecting cylinder 10, and is mounted on the main shaft 5. A space between the bran-collecting cylinder 10 and the rotary cylinder 12 serves as a bran-collecting chamber 13. Bran-scraping blades 14 are formed on an outer peripheral surface of a lower portion of the rotary cylinder 12 to be rotatable therewith within the bran-collecting chamber 13. A bran discharge port 15 is formed at an appropriate region of the bottom of the bran-collecting cylinder 10. The bran discharge port 15 is connected to a bag filter (not shown) and a bran-collecting fan (not shown) by a bran duct 16.

Figure 4A:
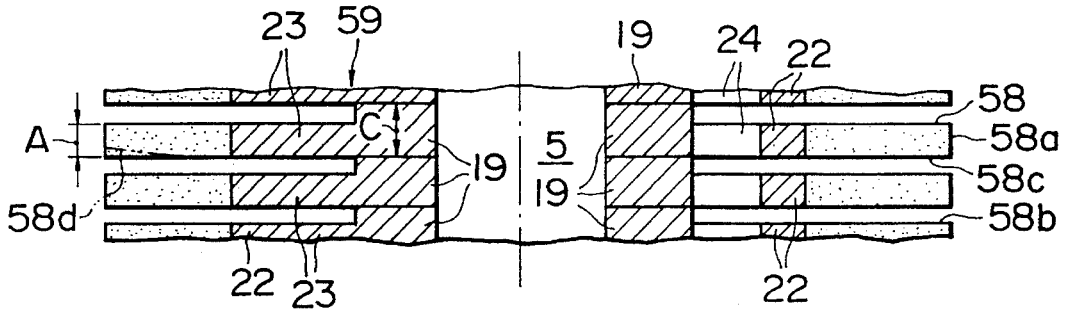
FIG. 4A is a sectional view taken along a line IVA—IVA of FIG. 3.
Figure 4B:
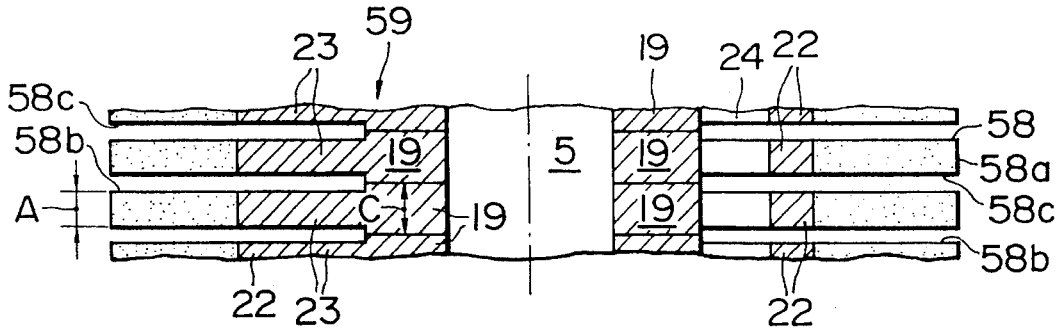
FIG. 4B is a view similar to FIG. 4A but showing a modified form of the invention.
Figure 4C:
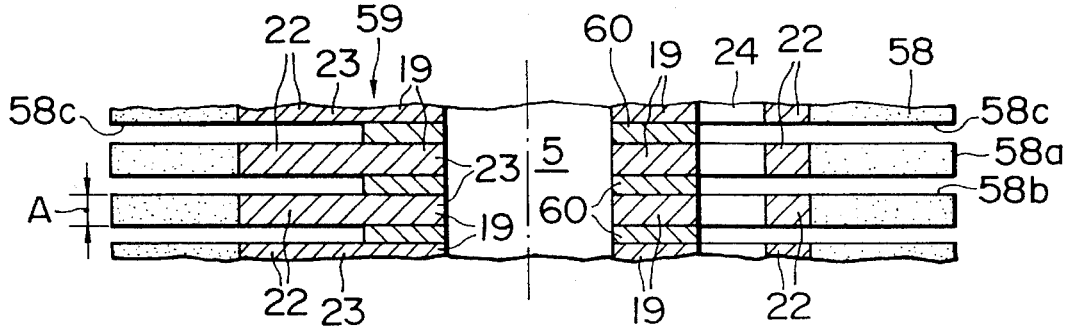
FIG. 4C is a view similar to FIG. 4A but showing another modified form of the invention.
Figure 5:
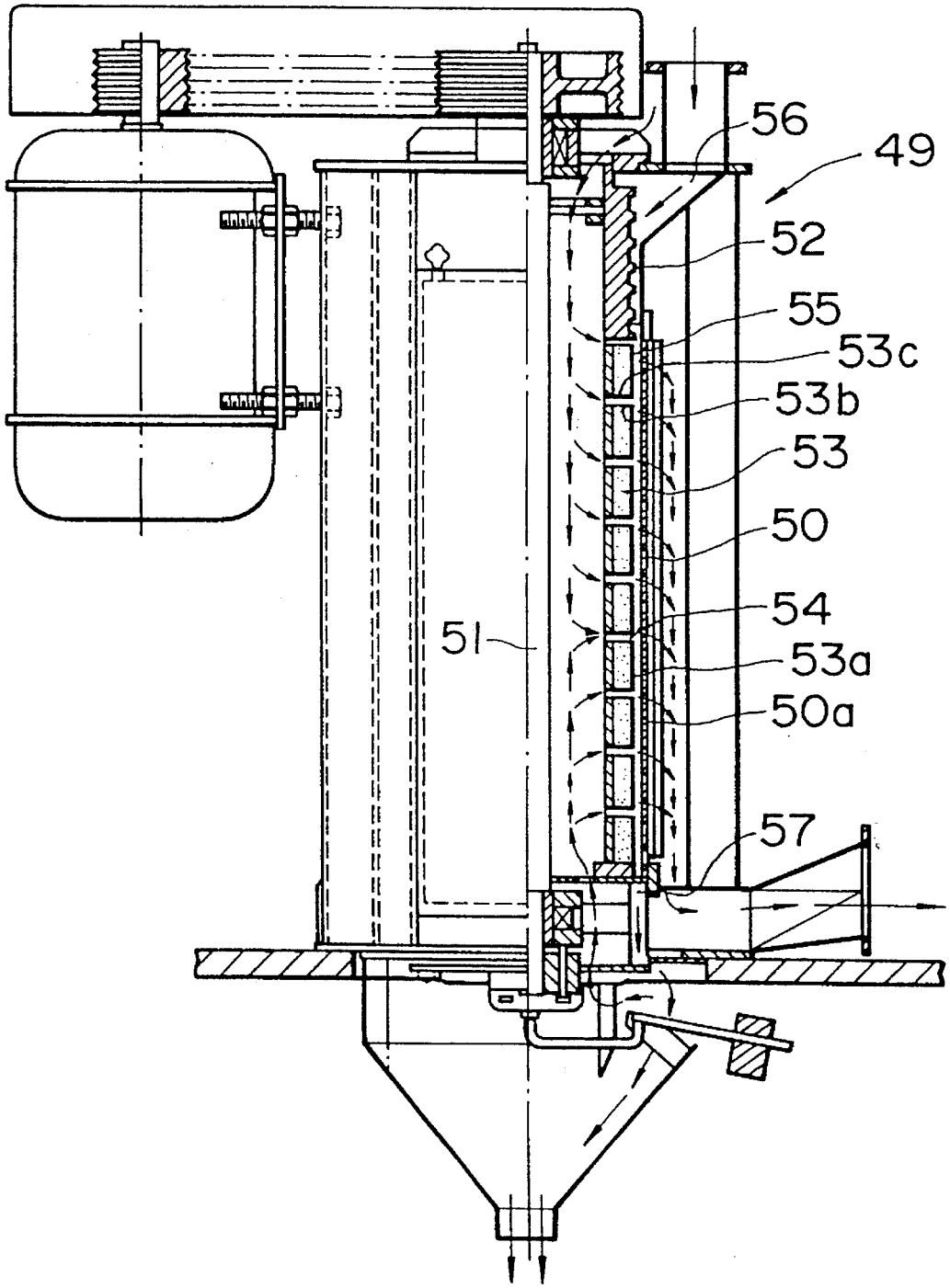
FIG. 5 PRIOR ART
FIG. 5 is a partly cross-sectional, front-elevational view of a conventional abrasive type vertical grain milling machine.

A rotary ring 17 is mounted on an upper end of the rotary cylinder 12, and a plurality of abrasive milling rolls 18 are provided on an upper side of the rotary ring 17. Each abrasive roll 18 comprises a support portion 59 of metal, and an annular abrasive portion 58 formed by bonding emery particles together. The support portion 59 comprises a boss portion 19, a ring portion 22, and arm portions 23. More specifically, a circular hole 20 through which the main shaft 5 passes, as well as a key groove 21, are formed through the boss portion 19 of the support portion 59 of the abrasive roll 18, and the boss portion 19 and the ring portion 22 are interconnected by the arm portions 23, so that a plurality of vent holes or openings 24 are formed through the support portion 59. An average size of emery particles for the abrasive portion 58 of the abrasive roll 18 at an upper part of a stack of rolls 18 may be different, i.e. greater or smaller, than that at a lower part of the stack of rolls 18. The abrasive portion 58, having the abrasive or emery particles deposited on its outer peripheral or side surface and its upper and lower end faces thereof, is fixedly mounted on the outer periphery of the ring portion 22 of the support portion 59. A thickness A of the abrasive portion 58 (including the emery particles surfaces) in the axial direction is 15~30 mm. If the thickness A of the abrasive portion 58 of the abrasive roll 18 is too small, the rice grain is liable to be ground unevenly by an outer peripheral or side surface **58*a* of the abrasive portion 58, so that the rice grain can not be milled or whitened uniformly. Therefore, the abrasive portion 58 need to have a certain degree of thickness. A space or gap 25, formed between any two adjacent abrasive rolls 18, serves as a jet air groove, and an axial thickness of this space 25, i.e. magnitude of the gap 25, is 7~10 mm. Referring to the reason for this, a short-size species of the rice grain 60 is about 5 mm long while a long-size species is about 8 mm long, and therefore in order that the rice grain 60 can intrude into the space 25 so as to be milled or whitened, it is most appropriate that the thickness of the space 25 should be 7~10 mm. In order that the space or gap 25 can be suitably formed between the opposed axial end faces 58*b* and 58*c* of any two adjacent ones of the stacked abrasive rolls 18, an axial thickness C of the boss portion 19 is larger by an amount of 7~10 mm than the axial thickness A of the arm portion 23, the ring portion 22 and the abrasive portion 58 of the support portion 59, as shown in FIG. 4A. Instead of projecting the boss portion 19 only at one end face of the abrasive roll 18 as shown in FIG. 4A, the boss portion 19 may be projected at both of the axial end faces of the abrasive roll 18 as shown in FIG. 4B. Another alternative is that the thickness C of the boss portion 19 may be equal to the thickness A of the abrasive portion 58 and the other relevant portions, in which case a spacer 60 is interposed between the boss portions 19 and 19 of any two adjacent abrasive rolls 18 and 18 as shown in FIG. 4Co In the case of the arrangements shown in FIGS. 4A and 4B, a spacer 60 may be interposed between two adjacent ones of all or part of the abrasive rolls 18. Further, the abrasive portion 58 may be tapered in such a manner that the axial thickness or dimension B of the space 25 is progressively increasing radially outwardly, as indicated by an imaginary line 58*d* in FIG. 4A**.

It has been confirmed through tests that when the thickness A of the abrasive roll 18 is 1.5~4 times larger than the thickness B of the space 25 serving as the jet air groove, a most preferred grain milling (whitening) effect can be achieved.

In the case where the grain to be milled is not rice grain but, for example, wheat grain, the length of the wheat grain is about 4.5 to 7 mm, and therefore the ratio A/B is substantially the same as that for rice grain.

All of the spaces 25 may have the same axial thickness B, or the axial thickness B of the spaces 25 may be decreased or increased downstream, that is, in a direction of flow of the grains. All of the abrasive portions 58 of the abrasive rolls 18 may have the same thickness A, or the thickness A of the abrasive portions 58 may be decreased or increased downstream, that is, in the direction of flow of the grains.

A spiral or helical feed roll 26 of a hollow cylindrical shape rests on the uppermost abrasive roll 18, and a boss 27 of the spiral roll 26 is fixed by a bolt 28 threaded into an upper end of the main shaft 5, so that the spiral roll 26 and the abrasive rolls 18 are integrally mounted on the main shaft 5. A hollow guide member 29 of a generally conical shape is fixedly mounted on an upper open end portion of the spiral roll 26. A plurality of openings or holes 30 are formed through a peripheral wall of the guide member 29. An outside air-introducing tube 31 is connected at one end thereof to each of the openings 30 in the guide member 29, and the other end of the outside air-introducing tube 31 is connected to an opening 33 formed in an upper cover 32. A supply amount control device 35 is provided at a grain supply port 34 in an upper end portion of the upper cover 32.

A bran-removing cylinder 36 in the form of a hollow, perforated cylinder is provided upright around the stack of abrasive rolls 18 to form a grain milling chamber (rice whitening chamber) 37 having a main portion between the bran-removing cylinder 36 and the stack of abrasive rolls 18. The bran-removing cylinder 36 is constituted by four bran-removing perforated walls 39 of an arcuate shape each of which extends between and is supported by respective adjacent ones of four support posts 38. Also, each of four cover members 40 of an arcuate shape extends between and is supported by respective adjacent ones of the four support posts 38 to form a bran-removing chamber 41, a lower end which is connected to the bran-collecting chamber 13. A grain discharge port 42 in communication with the grain milling chamber 37 is provided below the bran-removing cylinder 36, and a discharge chute 43 is connected to this discharge port 42. A resistance-imparting plate 45 is mounted on the discharge chute 43, and is urged toward the grain discharge port 42 by a weight 44. Preferably, a guide plate 46 for guiding the grains to the discharge chute 43 is provided at the discharge port 42. A resistance-imparting bar 47 is loosely fitted in a recess formed in each support post 38 so that the resistance bar 47 can be adjustably moved into and out of the grain milling chamber 37 by an adjustment knob bolt 48.

An operation of the abrasive type vertical grain milling machine 1 thus constructed will now be described specifically. Rice grain to be milled or whitened is supplied to the grain supply port 34 in such a manner that a rate or amount of flow of the rice grain is suitably controlled by the supply amount control device 35. The rice gain thus supplied flows downward along the conically inclined surface of the guide member 29 while being dispersed generally uniformly in the circumferential direction, and is further fed into the grain milling chamber 37 by the spiral roll 26. The rice grains 60 within the grain milling chamber 37 are hit or driven by the outer peripheral edge or surface of the rotating abrasive roll 18, and rollingly move within the grain milling chamber 37 along the bran-removing cylinder 36 while being stirred by the resistance bars 47, so that surface portions of the rice grains 60 are ground or removed by the emery particles on the peripheral or side surface 58*a* of the abrasive portions 58 of the abrasive rolls 18. Meanwhile, the rice grains 60 enter the space or gap 25 (whose axial size is larger than the length of the rice grain 60) serving as the jet air groove, and roll, rotate and revolve in the space 25, so that the rice grains 60 contact the emery particles on the upper and lower axial end faces 58*b* and 58*c* of the opposed abrasive portions 58, in various orientations over an effectively increased milling path, thereby grinding or scraping off the surface portions of the rice grains 60 proceeds. It should be noted that the rice grains 60 do not enter radially inward beyond the abrasive portions 58, because the rice grains 60 are constantly subjected to centrifugal forces due to the revolutions thereof according to the rotation of the rolls 18.

The rice grains thus moving while rolling toward the central portion (the main shaft 5) are discharged toward the bran-removing cylinder 36 under the influence of a centrifugal force due to the rotation of the abrasive rolls 18, and then are milled or whitened by the peripheral surface 58*a* of the subsequent abrasive roll 18, and then intrude into the subsequent space 25 under the influence of a grain feeding action of the spiral roll 26, so that the rice grains are milled or whitened by the upper and lower axial end faces 58*b* and 58*c* of the opposed abrasive portions 58 in the same manner as described above. Thus, the rice grains 60 within the grain milling chamber 37 are moved downward while repeatedly coming into and out of many spaces 25, and therefore the effective milling (rice whitening) area is increased, and the milling (rice whitening) efficiency is enhanced.

An outside air, having passed through the outside air-introducing tube 31, the guide member 29, a chamber 26*a* within the spiral roll 26 and the vent openings 24 in the abrasive roll(s) 18, is discharged in jets from the jet air grooves 25 by suction of the fan (not shown), and the bran powder separated from the rice grains 60 is immediately discharged from the grain milling chamber 37 to the bran-removing chamber 41 through perforations or holes 39a in the bran-removing perforated member 39. Then, the bran within the bran-removing chamber 41 is fed to the bag filter (not shown) via the bran-collecting chamber 13 and the bran duct 16.

The rice grain (whitened rice), which has arrived at the lower end of the grain milling chamber 37, is guided by the guide plate 46, and is discharged from the grain discharge port 42. As the resistance plate 45 is urged by the weight 44 to provide a pressing force, the rice grains are discharged against the pressing force of the resistance plate 45. The pressing force by the resistance plate 45 is, as a matter of course, transmitted to the rice grains 60 within the grain milling chamber 37 through the rice grains flowing down through regions between the grain milling chamber 37 and the discharge port 42, the pressure within the grain milling chamber 37 is kept to an appropriate level.

What is claimed is:

1. An abrasive type vertical grain milling machine comprising:

an upstanding bran-removing cylinder;

a main shaft rotatably mounted substantially vertically within said bran-removing cylinder;

a spiral roll mounted on said main shaft for feeding grain to be milled; and a plurality of abrasive rolls mounted on said main shaft for milling the grain, said plurality of abrasive rolls being spaced from one another along said main shaft to define a space between any two adjacent ones of said abrasive rolls serving as a jet air groove;

the interior of said bran-removing cylinder and said plurality of abrasive rolls cooperating to define a main portion of grain milling chamber therebetween, a grain supply portion at an upper part of said grain milling chamber, and a grain discharge portion at a lower part of said grain milling chamber;

wherein a said space serving as said jet air groove is of a size in a direction along the axis of the main shaft larger than the length of the grain being supplied to said grain milling chamber from said grain supply portion so that the grain can come into and out of a said space to be abraded therein.

2. A machine according to claim 1, in which an axial thickness of a said abrasive roll is 1.5~4 times larger than the size of said space.

3. An abrasive type vertical grain milling machine comprising:

an upstanding bran-removing cylinder;

a main shaft rotatably mounted substantially vertically within said bran-removing cylinder;

a spiral roll mounted on said main shaft for feeding grain to be milled; and a plurality of abrasive rolls mounted on said main shaft for milling the grain, at least one of said abrasive rolls comprising a support portion fitted on said main shaft at a boss portion thereof, and an annular abrasive portion fixedly secured to an outer periphery of said support portion, an axial thickness of said boss portion of said support portion in a direction along the axis of said main shaft being greater than the thickness of said abrasive portion in the same direction, said plurality of abrasive rolls being spaced from one another along said main shaft to define a space between any two adjacent ones of said abrasive rolls serving as a jet air groove;

the interior of said bran-removing cylinder and said plurality of abrasive rolls cooperating to define a main portion of a grain milling chamber therebetween, a grain supply portion at an upper end of said grain milling chamber, and a grain discharge portion at a lower end of said grain milling chamber;

wherein a said space serving as said jet air groove is of an axial size larger than the length of the grain being supplied to said grain milling chamber from said grain supply portion so that the grain can come into and out of said space to be abraded therein.

4. A machine according to claim 3, in which said support portion comprises said boss portion, a plurality of arm portions extending radially outwardly from said boss portion, and a ring portion integrally connected to outer ends of said arm portions, said abrasive portion being fixedly secured to an outer periphery of said ring portion.

5. A machine according to claim 3, in which said boss portion of said portion is projected at its one axial end face beyond said abrasive portion in an axial direction of said main shaft.

6. A machine according to claim 3, in which said boss portion of said support portion is projected at both of its axial end faces beyond said abrasive portion in an axial direction of said main shaft.

7. An abrasive type vertical grain milling machine comprising:

an upstanding bran-removing cylinder;

a main shaft rotatably mounted substantially vertically within said bran-removing cylinder;

a spiral roll mounted on said main shaft for feeding grain to be milled; and a plurality of abrasive rolls mounted on said main shaft for milling the grain, a spacer between at least two adjacent ones of said abrasive rolls, said plurality of abrasive rolls being spaced from one another along said main shaft to define a space between any two adjacent ones of said abrasive rolls serving as a jet air groove;

the interior of said bran-removing cylinder and said plurality of abrasive rolls cooperating to define a main portion of a grain milling chamber therebetween, a grain supply portion at an upper end of said grain milling chamber, and a grain discharge portion at a lower end of said grain milling chamber;

wherein a said space serving as a said jet air groove is of an axial size larger than the length of the grain being supplied to said grain milling chamber from said grain supply portion so that the grain can come into and out of a said space to be abraded therein.

* * * * *